United States Patent [19]

Yang

[11] Patent Number: 5,020,798

[45] Date of Patent: Jun. 4, 1991

[54] SPINNING TOP GAME KIT

[76] Inventor: Mang M. Yang, 897-B Six Oaks Cir., Norcross, Ga. 30093

[21] Appl. No.: 553,190

[22] Filed: Jul. 16, 1990

[51] Int. Cl.[5] ..... A63F 9/00; A63H 1/04

[52] U.S. Cl. ..... 273/440; 446/257; 446/261

[58] Field of Search ..... 273/1 G; 446/256-264

[56] References Cited

U.S. PATENT DOCUMENTS

| | | | |
|---|---|---|---|
| 45,816 | 1/1865 | Cramer | 446/260 |
| 1,109,562 | 9/1914 | Wingert | 446/262 |
| 1,261,854 | 4/1918 | Reynolds | 446/263 |
| 1,889,680 | 11/1932 | Marmito | 446/261 |

OTHER PUBLICATIONS

American Inventor, vol. XIV, No. 4, 9-1905, p. 27 et al., Fighting Tops.

*Primary Examiner*—Paul E. Shapiro
*Attorney, Agent, or Firm*—Leon Gilden

[57] ABSTRACT

A game kit organization includes a plurality of spinning tops, the spinning top includes a generally conical lower surface, a medial annular surface, and a convex upper surface for reception of a string to be wound about the convex upper surface to effect rotation of each top. The tops are sequentially spun by opponents to effect impact between opposing spinning tops. A modification of the invention includes projections selectively securable to the annular band to provide variations of impact between opposing tops, as well as providing for selectively securable projections mounted within the annular band to effect relative states of imbalance and impart desired wobble to opposing tops to vary a pathway of opposing tops to add a level of chance in effecting impact as noted above.

3 Claims, 4 Drawing Sheets

SPINNING TOP GAME KIT

BACKGROUND OF THE INVENTION

1. Field of the Invention

The field of invention relates to spinning top structure, and more particularly pertains to a new and improved spinning top game kit wherein the same utilizes opposed spinning tops to effect relative impact and scoring thereby.

2. Description of the Prior Art

Spinning top construction of various types have been utilized in the prior art to effect a gyroscopic type of rotation to a top structure. The instant invention sets forth an organization to define a game kit wherein a plurality of tops are utilized in conjunction relative to one another to effect selective impact between the tops to provide random scoring events between the tops due to impact. Prior art top structure may be found in U.S. Pat. No. 3,269,053 to Dawson, Jr. utilizing a spinning top with a cord structure of construction to effect a gyroscopic spin to the top.

U.S. Pat. No. 2,535,157 to Radovan sets forth a further example of a spinning top structure wherein the string portion remains tethered within the top construction to control traverse of the top about a support surface.

U.S. Pat. No. 2,142,299 to Begood sets forth a further example of a spinning top structure that maY rotate about either end.

U.S. Pat. No. 3,680,864 to Peterson sets forth a spinning top game organization wherein a field is provided with a top to maneuver within the field about various obstacles.

U.S. Pat. No. 4,681,320 sets forth a spinning top and board structure wherein the board may be manipulated and folded to manipulate travel of the spinning top.

As such, it may be appreciated that there continues to be a need for a new and improved spinning top game kit wherein the same addresses both the problems of ease of use as well as effectiveness in construction and in this respect, the present invention substantially fulfills this need.

SUMMARY OF THE INVENTION

In view of the foregoing disadvantages inherent in the known types of spinning top games now present in the prior art, the present invention provides a spinning top game kit wherein the same utilizes a plurality of spinning tops to provide adversarial impact between closed spinning tops of a plurality of players. As such, the general purpose of the present invention, which will be described subsequently in greater detail, is to provide a new and improved spinning top game kit which has all the advantages of the prior art spinning top game kits and none of the disadvantages.

To attain this, the present invention provides a game kit organization includes a plurality of spinning tops, the spinning top includes a generally conical lower surface, a medial annular surface, and a convex upper surface for reception of a string to be wound about the convex upper surface to effect rotation of each top. The tops are sequentially spun by opponents to effect impact between opposing spinning tops. A modification of the invention includes projections selectively securable to the annular band to provide variations of impact between opposing tops, as well as providing for selectively securable projections mounted within the annular band to effect relative states of imbalance and impart desired wobble to opposing tops to vary a pathway of opposing tops to add a level of chance in effecting impact as noted above.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. No. and Trademark Office and the public generally, and especially the scientists, engineers and practitioners in the art who are not familiar with patent or legal terms or phraseology, to determine quickly from a cursor inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spinning top game kit which has all the advantages of the prior art spinning top game kits and none of the disadvantages.

It is another object of the present invention to provide a new and improved spinning top game kit which may be easily and efficiently manufactured and marketed.

It is a further object of the present invention to provide a new and improved spinning top game kit which is of a durable and reliable construction.

An even further object of the present invention is to provide a new and improved spinning top game kit which is susceptible of a low cost of manufacture with regard to both materials and labor, and which accordingly is then susceptible of low prices of sale to the consuming public, thereby making such spinning top game kits economically available to the buying public.

Still yet another object of the present invention is to provide a new and improved spinning top game kit which provides in the apparatuses and methods of the prior art some of the advantages thereof, while simultaneously overcoming some of the disadvantages normally associated therewith.

Still another object of the present invention is to provide a new and improved spinning top game kit wherein the same utilizes selective impact between opposing players to effect scoring and impact events between the players and the tops.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
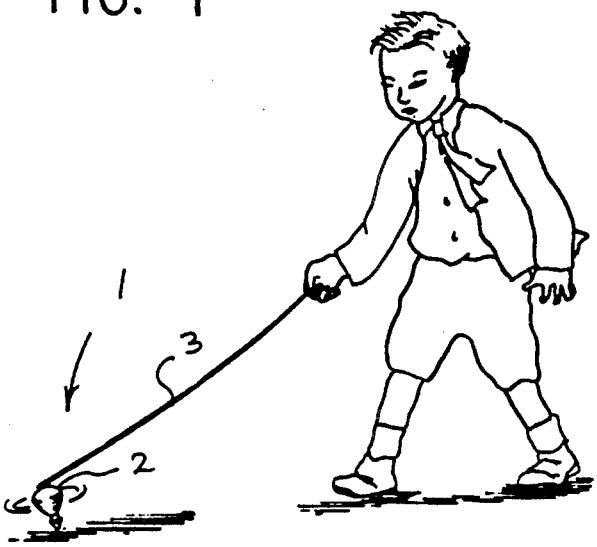
FIG. 1 is an isometric illustration of a prior art spinning top construction.

With reference now to the drawings, and in particular to FIGS. 1 to 8 thereof, a new and improved spinning top game kit embodying the principles and concepts of the present invention and generally designated by the reference numeral 10 will be described.

FIG. 1 illustrates a prior art spinning top member 1, with a spinning top structure 2 and a tether line 3 coaxially mounted to the spinning top subsequent to rotation thereof.

Figure 2:
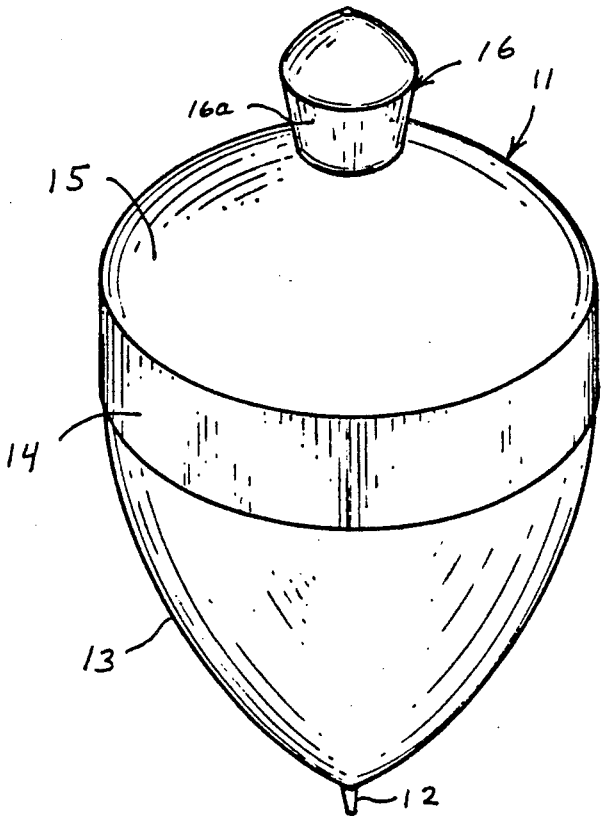
PRIOR ART FIG. 2
FIG. 2 is an isometric illustration of a single spinning top member of a plurality of members utilized by the instant invention.
Figure 3:
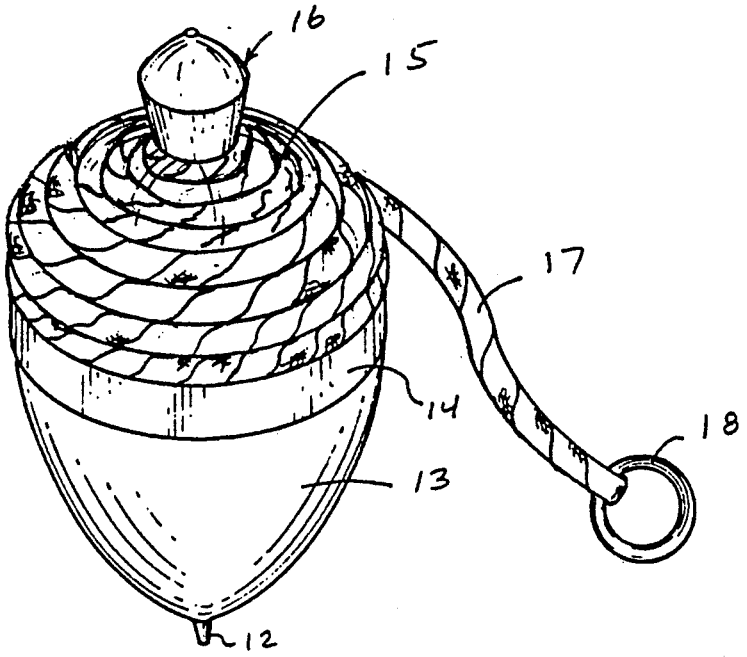
FIG. 3 is an isometric illustration of the spinning top member in association with a string to effect rotation of the spinning top.
Figure 4:
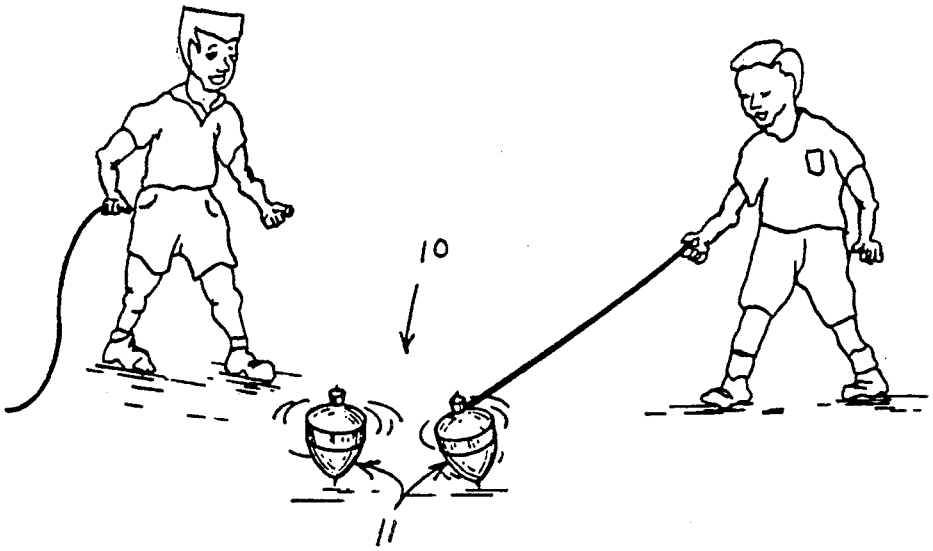
FIG. 4 is an isometric illustration of a plurality of the spinning tops utilized in a game environment between opposing players.
Figure 5:
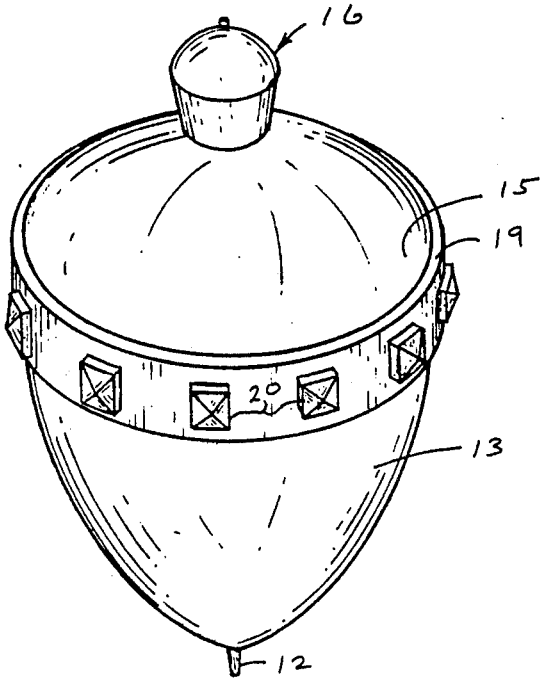
FIG. 5 is an isometric illustration of the spinning top construction utilizing a removable band member mounted thereon.
Figure 6:
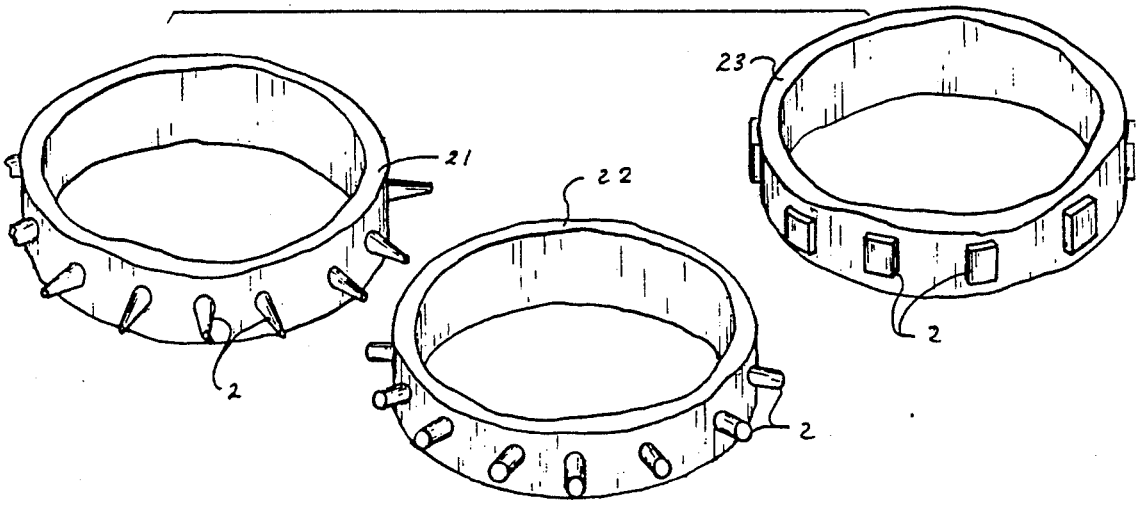
FIG. 6 is an isometric illustration of a plurality of replaceable elastomeric band members utilized by the instant invention.

More specifically, the spinning top game kit 10 of the instant invention essentially comprises a plurality of spinning top members 11 each (as illustrated in FIG. 2 for example) including a balancing projection 12 extending coaxially and exteriorly of a lower end of the top member, wherein in the lower end defines an inverted conical lower surface 13 underlying a medially oriented annular surface 14 whose axis is aligned coaxially with the axis of the top member 11 and is defined by a predetermined height. A convex upper surface 15 extends above the annular surface 14, with a crown member 16 coaxially and integrally mounted medially of the upper surface 15, with the crown member 16 including an inverted conical side wall surface **16*a* to define an abutment surface for a string member 17 wound thereabout to effect a spinning of each top member 11, in a manner as illustrated in FIG. 3. FIG. 4 illustrates the plurality of top members 11, wherein initially one of the plurality of players effects spinning of the top member 11, with a further player subsequently directing a further top member of the plurality of top members to effect impact thereby. The plurality of impacts and success in effecting impact effects scoring by each player, with a player that has successfully presented a further top member to effect the greatest number of successful impacts is subsequently declared a winner. Each player alternatively effects aiming and impact of a top member 11** into a first top member that is already in a spinning situation.

To enhance the element of chance and effect enhanced visual activity between impact between top members, each top member includes a plurality of elastomeric bands defined by a first, second, third, and fourth elastomeric band 19, 21, 22 and 23 respectively. Each elastomeric band is defined by a height equal to the predetermined height for mounting about the annular surface 14. Each elastomeric band includes a respective first, second, third, and fourth annular array of equally spaced projections **20*a*, 20*b*, and 20*c* respectively of various configurations to effect various angles of impact of the plurality of the tops relative to one another, as well as to enhance centrifugal force of the organization by providing projections extending radially outwardly of the annular surface 14**. The projections are therefore of various lengths and configurations to provide the aforenoted effect.

Figure 7:
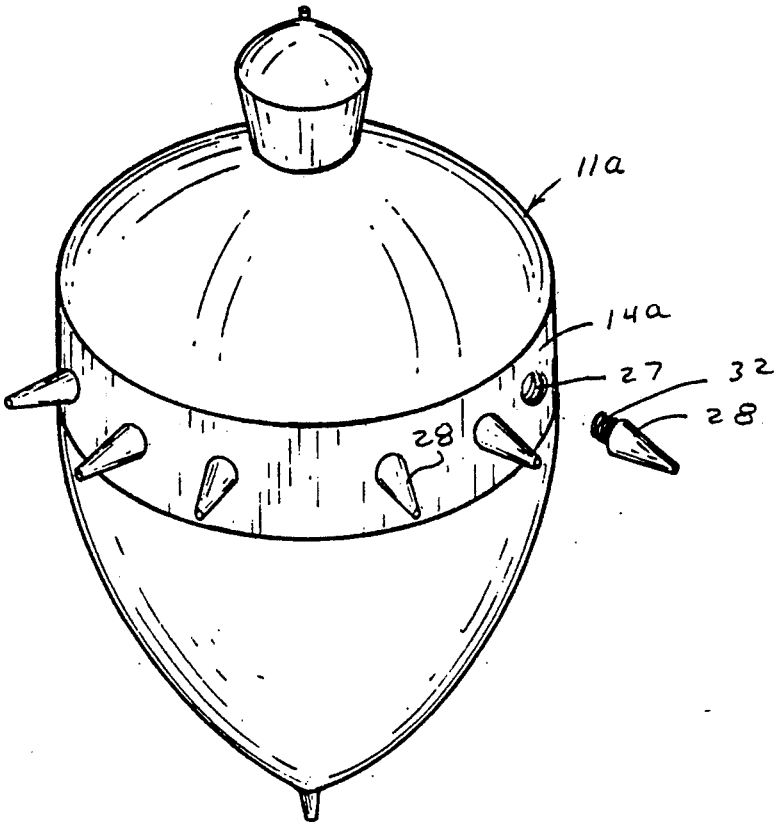
FIG. 7 is an isometric illustration of a modified spinning top member utilizing threaded apertures to receive threaded projections for use in the game organization.
Figure 8:
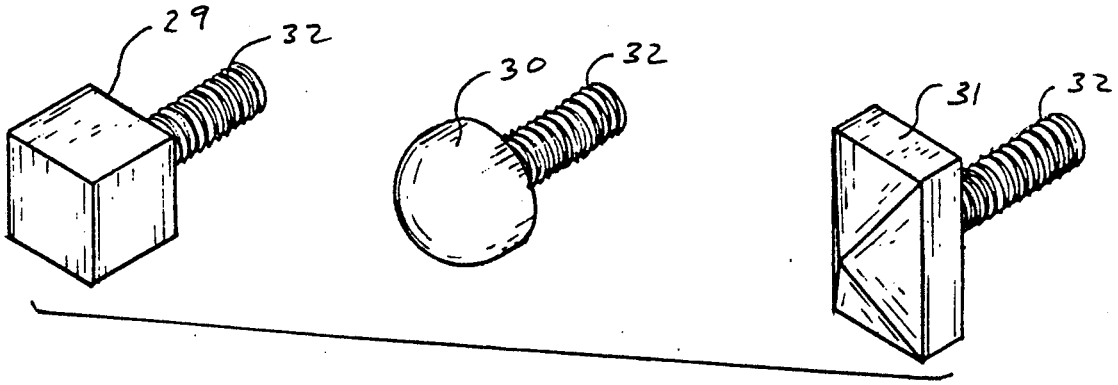
FIG. 8 is an isometric illustration of a plurality of replaceable projections utilized by the instant invention.

FIG. 7 illustrates a modified spinning top member **11*a*, including the general configuration of the top as illustrated in FIG. 2, wherein the annular band surface 14 is defined as a modified annular band surface also of the predetermined height, but including a circumferentially arranged array of threaded bores 27 radially directed interiorly of the annular band 14*a* to threadedly receive a threaded boss 32 of an associated projection of a series of projections, including a first, second, third, and fourth projection member 28, 29, 30, and 31. Each projection member is defined of a varying weight and length beyond the threaded boss 32 to permit an individual to provide an imbalance to the top member 11*a* to thereby effect a wobble and element of chance in the effective path of the top member when spun to effect impact with a first or target top member in a manner as illustrated in FIG. 4**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spinning game top kit comprising, a plurality of spinning top members, each spinning top member including an inverted conical lower surface, with a balancing projection directed coaxially and exteriorly of the conical lower surface, and an annular medial surface coaxially aligned and positioned medially with the spinning top member, and a convex upper surface, the convex upper surface including a crown member positioned coaxially of the spinning top member, with each crown member including an inverted conical side wall surface, and each spinning top member further including a string member for securement about the convex upper surface to impart gyroscopic rotation to the spinning top member, and wherein each spinning top member annular surface is defined by a predetermined height, and each spinning top member further includes a plurality of elastomeric bands for securement about the annular surface, with each elastomeric band defined by a height equal to the predetermined height.

2. A game kit as set forth in claim 1 wherein the plurality of elastomeric bands includes a first, second, third, and fourth elastomeric band, and each elastomeric band includes a respective first, second, third, and fourth series of projections, each series of projections arranged in an equally spaced annular array about each band.

3. A game kit as set forth in claim 2 wherein each series of projections is of a varying length and weight to vary a centrifugal force applied to each of the spinning top members.

* * * * *